US009111510B2

(12) United States Patent
Huang

(10) Patent No.: US 9,111,510 B2
(45) Date of Patent: Aug. 18, 2015

(54) DISPLAY APPARATUS AND METHOD FOR ROTATING DISPLAYED CONTENT

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Yong-Long Huang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 209 days.

(21) Appl. No.: 13/893,350

(22) Filed: May 14, 2013

(65) Prior Publication Data

US 2013/0328936 A1 Dec. 12, 2013

(30) Foreign Application Priority Data

Jun. 6, 2012 (CN) ..... 2012 1 0184177

(51) Int. Cl.
*G09G 5/00* (2006.01)
*G09G 5/38* (2006.01)

(52) U.S. Cl.
CPC ..... *G09G 5/38* (2013.01); *G09G 2340/0492* (2013.01)

(58) Field of Classification Search
None
See application file for complete search history.

(56) References Cited

U.S. PATENT DOCUMENTS

| | | | | |
|---|---|---|---|---|
| 5,173,709 | A * | 12/1992 | Lauro et al. | 342/443 |
| 8,471,869 | B1 * | 6/2013 | Tseng | 345/659 |
| 8,730,267 | B2 * | 5/2014 | Petersen | 345/659 |
| 2010/0002015 | A1 * | 1/2010 | Handa | 345/650 |

* cited by examiner

*Primary Examiner* — Ryan R Yang
(74) *Attorney, Agent, or Firm* — Novak Druce Connolly Bove + Quigg LLP

(57) ABSTRACT

A display apparatus includes a detector to detect an angle of a center line of the display apparatus relative to a horizontal line of the south geomagnetic pole when in the horizontal plane. The apparatus stores a reference angle. The apparatus determines the rotation angle of the display apparatus by subtracting the reference angle from the angle of the center line of the display apparatus relative to the horizontal line of the south geomagnetic pole; and rotates display content according to the rotation angle. A related method is also disclosed.

6 Claims, 8 Drawing Sheets

DISPLAY APPARATUS AND METHOD FOR ROTATING DISPLAYED CONTENT

BACKGROUND

1. Technical Field

The present disclosure relates to display apparatuses and methods, and particularly, to a display and a method capable of automatically rotating displayed content.

2. Description of Related Art

When some types of display apparatuses are rotated from horizontal orientation to vertical orientation, the display apparatuses can automatically rotate display content with the rotation of the display apparatuses. However, when the displays of the display apparatuses are orientated flat in a horizontal plane and then rotated along the horizontal plane while being kept the flat orientation, the display apparatuses can not automatically rotate display content with the rotation of the display apparatus. Thus, there is room for improvement in the art.

BRIEF DESCRIPTION OF THE DRAWINGS

Many aspects of the present disclosure should be better understood with reference to the following drawings. The units in the drawings are not necessarily drawn to scale, the emphasis instead being placed upon clearly illustrating the principles of the present disclosure. Moreover, in the drawings, like reference numerals designate corresponding portions throughout the several views.

DETAILED DESCRIPTION

Embodiments of the present disclosure will be described, with reference to the accompanying drawings.

Figure 1:
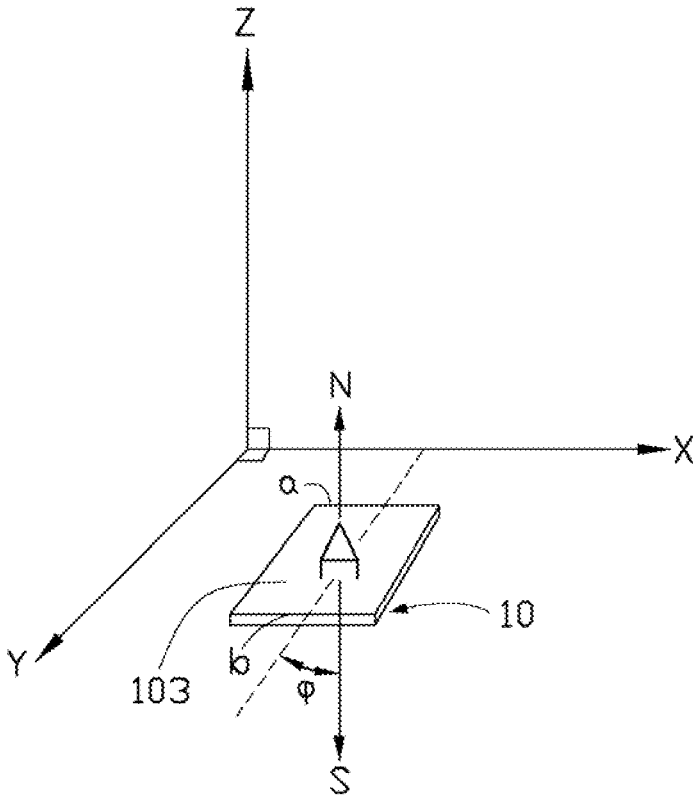
FIG. 1 is a schematic view showing a display apparatus placed on a horizontal plane, in accordance with an exemplary embodiment.

FIG. 1 shows a display apparatus 10 placed on a horizontal plane. The display apparatus 10 may be a portable electronic device (e.g. a smart phone) including a screen 103. In this embodiment, initially, the display apparatus 10 is placed flat, in a horizontal plane, as defined by an X-Y coordinate system, and a top sidewall a and a bottom sidewall b of the display apparatus 10 are parallel to the X-axis. An angle of a line through the center of the screen 103, across the longest part of the screen 103(shown in dotted line in FIG. 1, hereinafter longitudinal center line) relative to a horizontal line of the south geomagnetic pole, is defined as a reference angle ϕ. The reference angle ϕ is pre-stored in the display apparatus 10.

Figure 2:
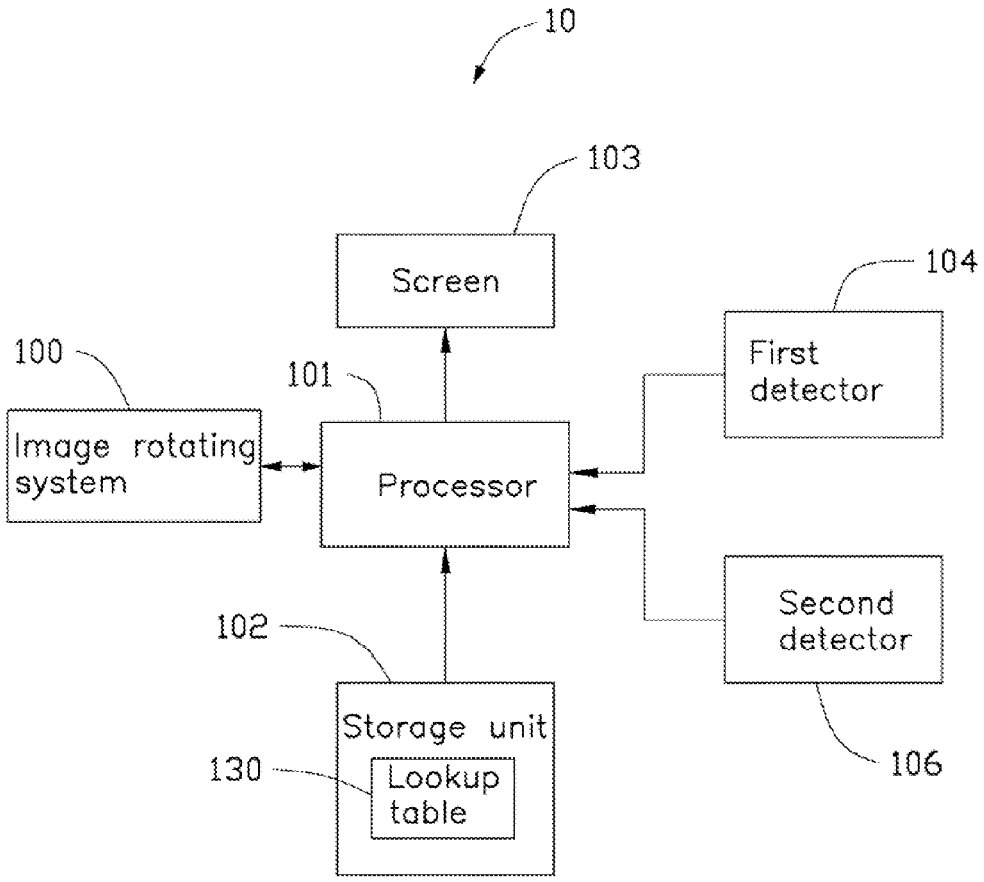
FIG. 2 is a block diagram of the display apparatus, in accordance with an exemplary embodiment.

Referring to FIG. 2, the display apparatus 10 further includes a processor 101, a storage unit 102, a first detector 104, a second detector 106, and an image rotating system 100. The storage unit 102 stores the reference angle ϕ and a lookup table 130.

The second detector 106 detects an angle of the longitudinal center line relative to the direction of gravity, and generates second detection signals according to the detected angle. In this embodiment, the second detector 106 is a gravity ball.

The processor 101 determines whether the screen 103 is in the horizontal plane according to the second direction signals. When the screen 103 is horizontal, that is, the angle of the longitudinal center line relative to the direction of the gravity is 90 degrees or 270 degrees, the processor 101 outputs a control signal to the first detector 104 to activate the first detector 104.

When the first detector 104 is activated, the first detector 104 detects an angle of the longitudinal center line relative to the horizontal line of the south geomagnetic pole, and generates first detection signals according to the detected angle.

The processor 101 further processes the first detection signals and converts the first detection signals into digital signals.

The processor 101 further computes a rotation angle of the screen 103, while the screen 103 itself is still lying flat, according to the digital signals and the lookup table 130, and rotates display content according to the rotation angle and the reference angle ϕ. The lookup table 130 (see below) records relationships between different digital signals and different angles of the longitudinal center line relative to the horizontal line of the south geomagnetic pole, and each incremental digital signal corresponds to an angle of ten degrees.

Lookup Table

| Digital signal | Angle (/°) |
|---|---|
| 00000001 | 0 (360) |
| 00000010 | 10 |
| 00000011 | 20 |
| 00000100 | 30 |
| 00000101 | 40 |
| . . . | . . . |
| 00010001 | 350 |

Figure 3:
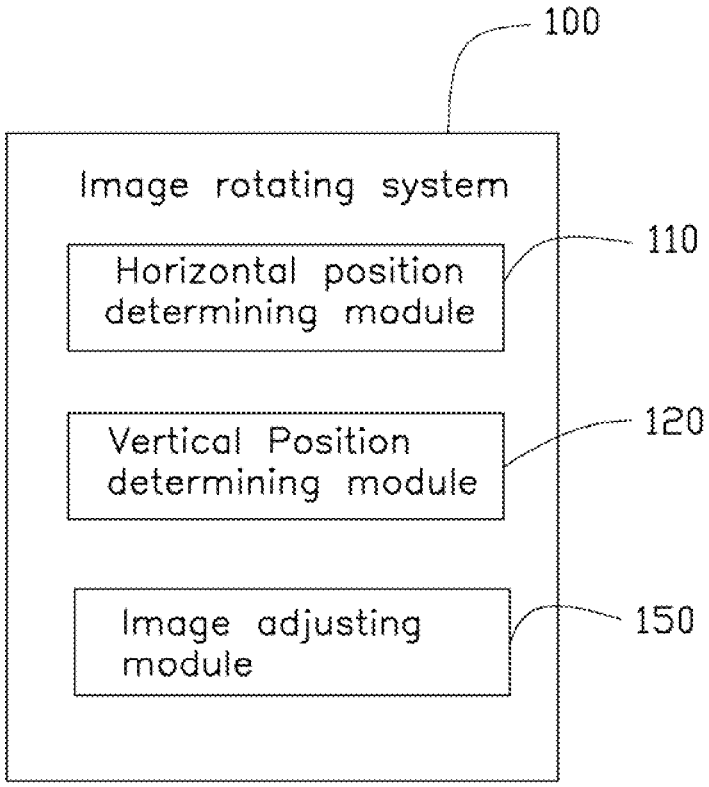
FIG. 3 is a block diagram of functional modules of an image rotating system of the display apparatus of FIG. 1, in accordance with an exemplary embodiment.

Referring to FIG. 3, the image rotating system 100 includes a horizontal position determining module 110, a vertical position determining module 120, and an image adjusting module 150. The image rotating system 100 is stored in the storage unit 102 and executable by the processor 101.

The vertical position determining module 120 determines the angle of the longitudinal center line relative to the direction of gravity according to the second detection signals, and thus determines whether the screen 103 is in the horizontal plane according to the detected angle, and generates and outputs the control signal to start the first detector 104 when the screen 103 is found to be in the horizontal plane.

The horizontal position determining module 110 converts the first detection signals into a digital signal, determines the angle of the longitudinal center line relative to the horizontal line of the south geomagnetic pole according to the digital signal and the lookup table 130, obtains the reference angle ϕ from the storage unit 102, and further determines the rotation angle of the screen 103 by subtracting the reference angle ϕ from the angle of the longitudinal center line relative to the horizontal line of the south geomagnetic pole. If the screen 103 is rotated counterclockwise, whilst still remaining horizontal, the rotation angle is negative, and if the screen 103 is rotated clockwise, whilst still remaining horizontal, the rotation angle is positive.

The image adjusting module 150 adjusts the displayed position of displayed content according to the rotation angle, causing the display content to be rotated with the rotation of the screen 103 when the display apparatus 10 is rotated in the horizontal plane.

Figure 4:
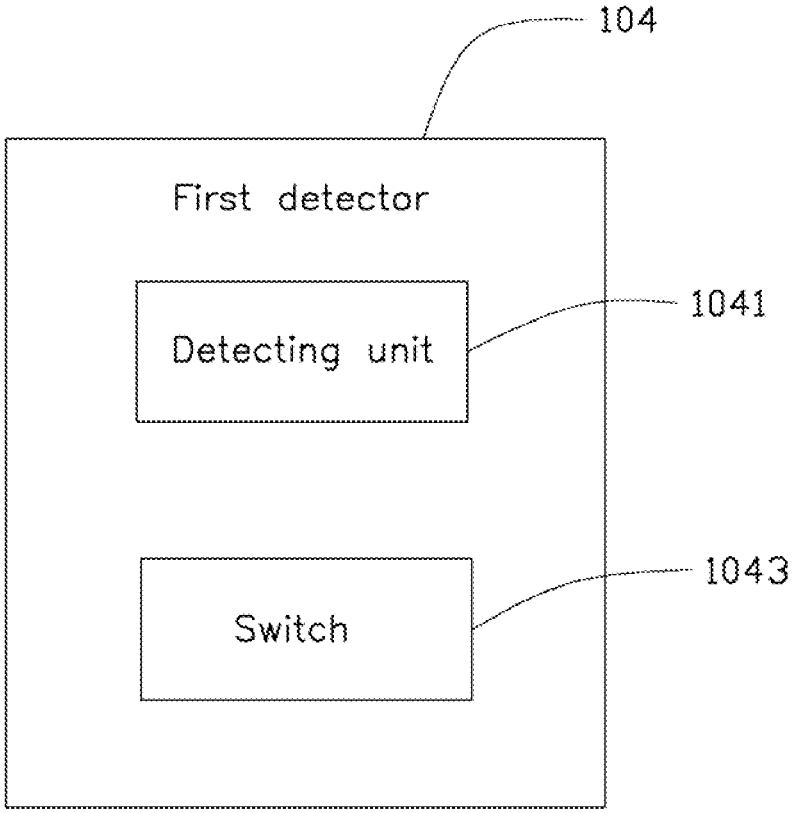
FIG. 4 is a block diagram of a first detector of the display apparatus of FIG. 1, in accordance with an exemplary embodiment.
Figure 5:
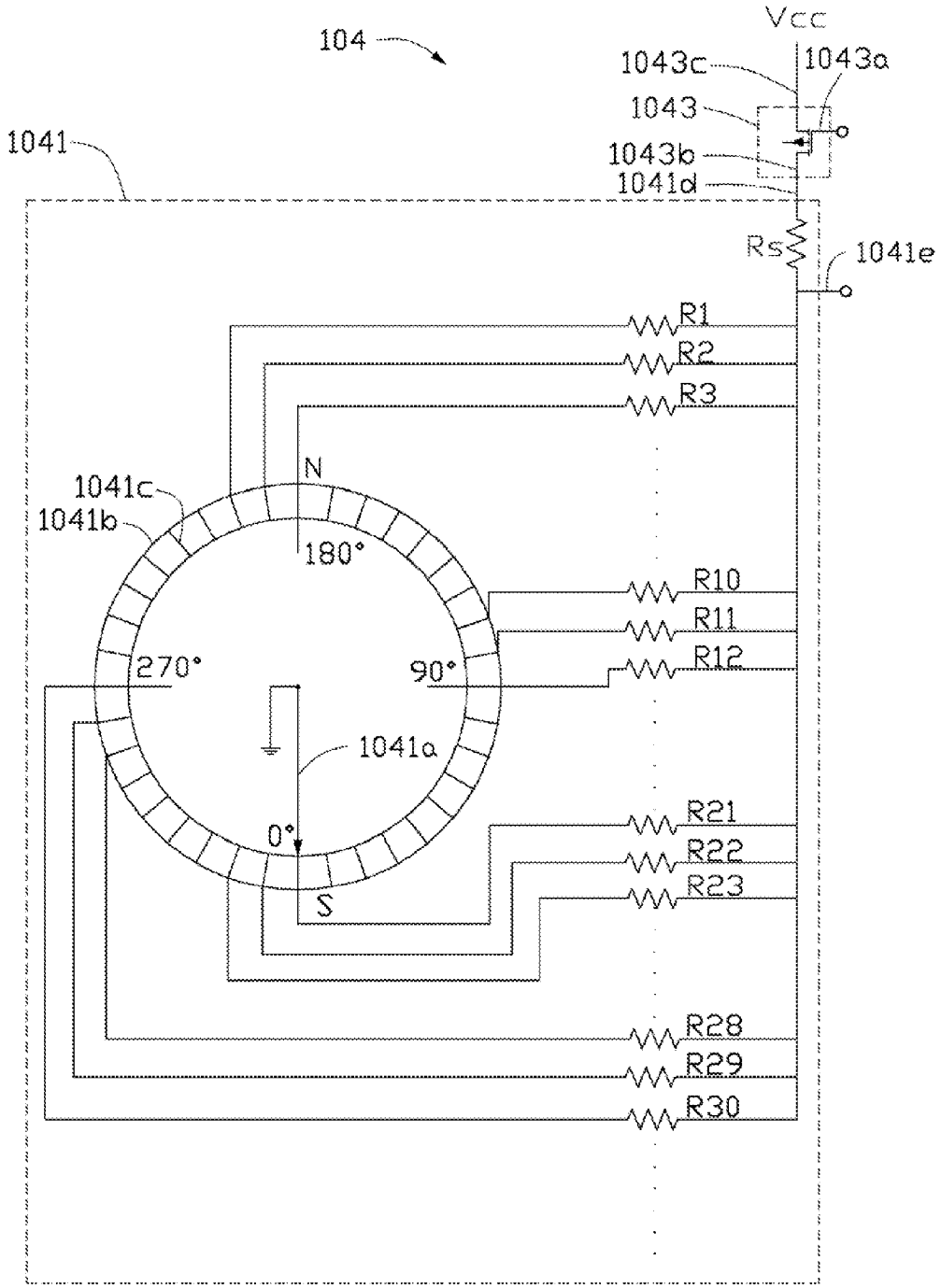
FIG. 5 is a schematic view of the first detector of FIG. 4.

Referring to FIGS. 4-5, the first detector 104 includes a detecting unit 1041, and a switch 1043. The detecting unit 1041 detects the angle of the longitudinal center line relative to the horizontal line of the south geomagnetic pole, and outputs the first detection signals according to the detected angle. The detecting unit 1041 includes a magnetic needle 1041*a*, a compass 1041*b*, a number of conductive terminals 1041*c* (hereinafter conductive terminals P1~Pn), an input port 1041*d*, and an output port 1041*e*.

A first end of the magnetic needle 1041*a* is connected to a center of the compass 1041*b* and grounded. The magnetic needle 1041*a* is conductive and always points horizontally to the south geomagnetic pole.

Figure 6:
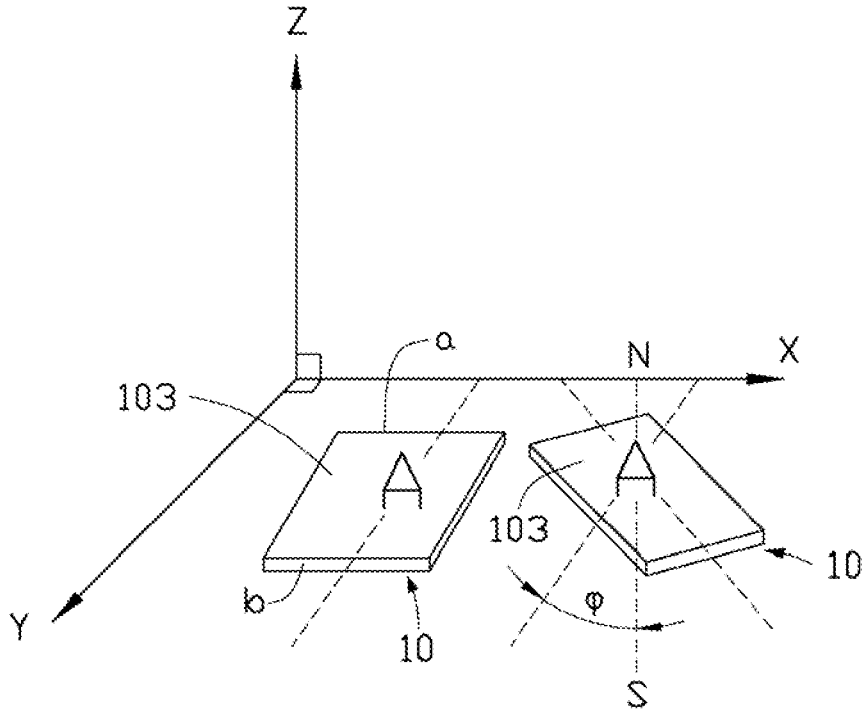
FIG. 6 is similar to FIG. 1, but showing the display apparatus of FIG. 1 rotated through the horizontal plane.
Figure 7:
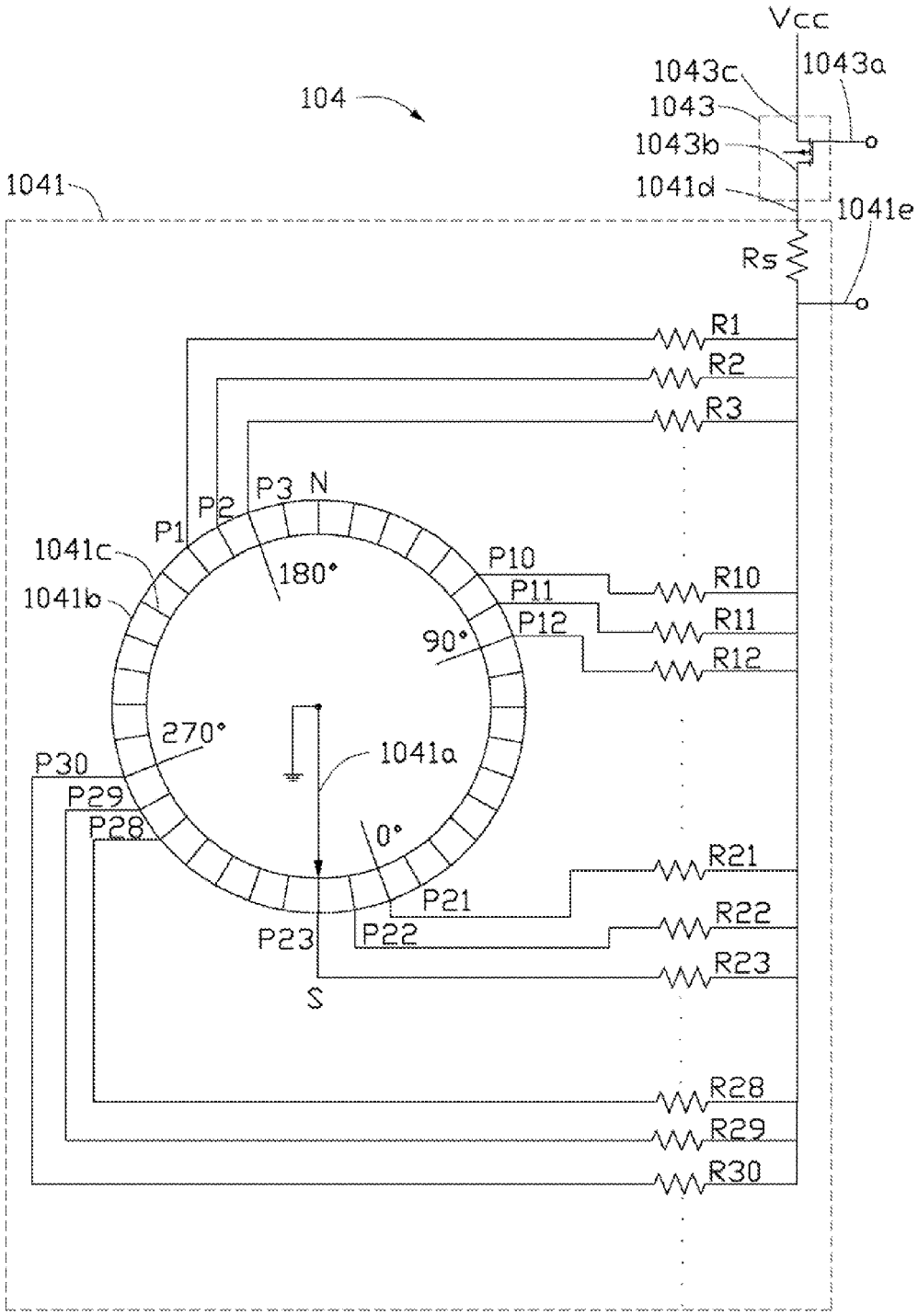
FIG. 7 is similar to FIG. 5, but showing the direction detector rotated with the rotation of the display apparatus of FIG. 1 in the horizontal plane.

The compass 1041*b* is rotatably mounted on the display apparatus 10. When the display apparatus 10 is rotated in the horizontal plane (see FIG. 6), the compass 1041*b* is rotated with the rotation of the display apparatus 10 (see FIG. 7). The conductive terminals P1~Pn are uniformly arranged on the compass 1041*b*. When the compass 1041*b* is rotated with the display apparatus 10, a second end of the magnetic needle 1041*a*, always pointing towards the south geomagnetic pole, contacts the conductive terminal Pi, where i<=n.

In this embodiment, each conductive terminal Pi is preset to correspond to a rotation angle. The display apparatus 10 determines the angle of the longitudinal center line relative to the horizontal line of the south geomagnetic pole by determining the connection between the magnetic needle 1041*a* and a conductive terminal Pi. In this embodiment, the conductive terminals P1~Pn are each connected to a resistor (resistors R1~Rn) having different resistances. The resistors R1~Rn are electrically connected to the output port 1041*e*. A resistor Rs is connected between the input port 1041*d* and the output port 1041*e*. The display apparatus 10 determines the angle of the longitudinal center line relative to the horizontal line of the south geomagnetic pole by detecting the voltage of the output port 1041*e*. When different conductive terminals 1041*c* contact the magnetic needle 1041*a*, the voltages of the output port 1041*e* are different. Thus, the display apparatus 10 can determine which conductive terminal 1041*c* is contacting the magnetic needle 1041*a* by detecting the voltage of the output port 1041*e*, and accordingly determines the angle of the longitudinal center line relative to the horizontal line of the south geomagnetic pole as each conductive terminal 1041 Pi corresponds to one ten-degree angle.

The switch 1043 is connected between the detecting unit 1041 and the power source Vcc. The switch 1043 includes a control terminal 1043*a*, a first conductive terminal 1043*b* connected to the input port 1041*d*, and a second conductive terminal 1043*c* connected to the power source Vcc. When the control terminal 1043*a* receives the control signal from the processor 101, the first conductive terminal 1043*b* is connected to the second conductive terminal 1043*c*, and the switch 1043 is turned on. At this point, the power source Vcc provides power to the detecting unit 1041 to activate the detecting unit 1041. Before the control terminal 1043*a* receives a control signal from the processor 101, the first conductive terminal 1043*b* is not connected to the second conductive terminal 1043*c*. At this point, the detecting unit 1041 receives no power from the power source Vcc and is thus disabled.

Figure 8:
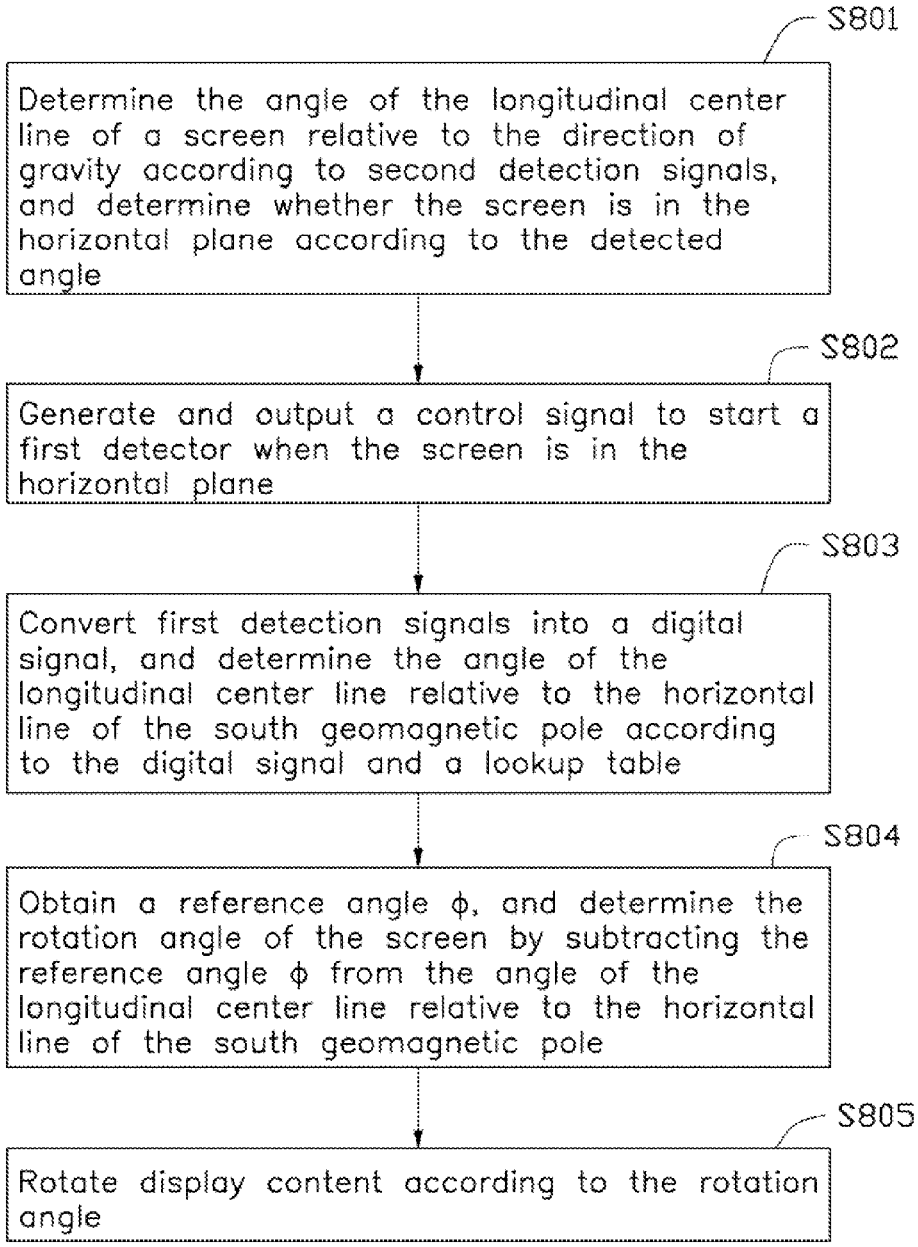
FIG. 8 is a flowchart of a method for rotating display content, in accordance with an exemplary embodiment.

FIG. 8 is a flowchart of a method for rotating a displayed image, in accordance with an exemplary embodiment.

In step S801, the vertical position determining module 120 determines the angle of the longitudinal center line of the screen 103 relative to the direction of gravity according to the second detection signal, and determines whether the screen 103 is in the horizontal plane according to the detected angle.

In step S802, the vertical position determining module 120 generates and outputs the control signal to start the first detector 104 when the screen 103 is found to be in the horizontal plane.

In step S803, the horizontal position determining module 110 converts the first detection signals into a digital signal, and determines the angle of the longitudinal center line relative to the horizontal line of the south geomagnetic pole according to the digital signal and the lookup table 130.

In step S804, the horizontal position determining module 110 obtains the reference angle ϕ from the storage unit 102, and further determines the rotation angle of the screen 103 by subtracting the reference angle ϕ from the angle of the longitudinal center line relative to the horizontal line of the south geomagnetic pole.

In step S805, the image adjusting module 150 rotates display content according to the rotation angle.

In alternative embodiments, the second detector 106 and the vertical position detecting module 120 can be absent. The display apparatus 10 can determine a horizontal or non-horizontal orientation according to user input. For example, when the user inputs a command to active the first detector 104, the display apparatus 10 determines that it is presently in the horizontal plane.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A display apparatus comprising:

a first detector to detect an angle of a center line of the display apparatus relative to a horizontal line of the south geomagnetic pole, and generate first detection signals according to the detected angle, the center line being across a longest part of the display apparatus;

a storage unit storing a reference angle and a lookup table recoding relationships between different digital signals and different angles, in the lookup table, each digital signal corresponding to one angle, the reference angle being an angle of the center line relative to the horizontal line of the south geomagnetic pole when the display apparatus is placed in a horizontal plane where the center line is parallel to a Y axis of an X-Y coordinate system defining the horizontal plane;

a processor; and a plurality of modules stored in the storage unit and executable by the processor, the plurality of modules comprising:

a horizontal position determining module to convert the first detection signals into a digital signal, determine the angle of the center line relative to the horizontal line of the south geomagnetic pole according to the digital signal and the lookup table, obtain the reference angle from the storage unit, and further determine a rotation angle of the display apparatus by subtracting the reference angle from the angle of the center line of the display apparatus relative to the horizontal line of the south geomagnetic pole; and an image adjusting module to rotate display content according to the rotation angle.

2. The display apparatus as described in claim 1, wherein the first detector comprises a detecting unit and a switch configured to be electrically connected between the detecting unit and a power source, when the switch is turned on, the detecting unit receives power from the power source and is activated, the detecting unit is to detect the angle of the center line of the display apparatus relative to the horizontal line of the south geomagnetic pole, and generate the first detection signals according to the detected angle.

3. The display apparatus as described in claim 2, wherein the detecting unit comprises a magnetic needle, a compass rotatably mounted in the display apparatus, a plurality of conductive terminals uniformly arranged on the compass, an input port, and an output port, a first end of the magnetic needle is connected to a center of the compass and grounded, the magnetic needle is conductive and always points horizontally to the south geomagnetic pole, a second end of the magnetic needle pointing horizontally to the south geomagnetic pole contacts one of the conductive terminals, each of the conductive terminals corresponds to an angle, the conductive terminals are respectively connected to first resistors having different resistance, the output port is electrically connected to the first resistors, the output port is connected to the input port via a second resistor, the input port is connected to the power source via the switch.

4. The display apparatus as described in claim 1, further comprising a second detector to detect an angle of the center line relative to a direction of gravity, and generate second detection signals according to the detected angle, the plurality of modules further comprising a vertical position determining module to determine the angle of the center line relative to the direction of gravity according to the second detection signals, determine whether the display apparatus is in the horizontal plane according to the detected angle, and generate and output a control signal to start the first detector when the display apparatus is in the horizontal plane.

5. A method for rotating displayed content applied in a display apparatus, the display apparatus comprising a first detector and a storage unit, the first detector being to detect an angle of a center line of the display apparatus relative to a horizontal line of the south geomagnetic pole, and generate first detection signals according to the detected angle, the center line being across a longest part of the display apparatus, the storage unit storing a reference angle and a lookup table recoding relationships between different digital signals and different angles, in the lookup table, each digital signal corresponding to one angle, the reference angle being an angle of the center line relative to the horizontal line of the south geomagnetic pole when the display apparatus is placed in a horizontal plane where the center line is parallel to a Y axis of an X-Y coordinate system defining the horizontal plane, the method comprising:

converting the first detection signals into a digital signal, and determining the angle of the center line relative to the horizontal line of the south geomagnetic pole according to the digital signal and the lookup table;

obtaining the reference angle from the storage unit, and determining a rotation angle of the display apparatus by subtracting the reference angle from the angle of the center line of the display apparatus relative to the horizontal line of the south geomagnetic pole; and rotating display content according to the rotation angle.

6. The method as described in claim 5, further comprising:

determining the angle of the center line relative to a direction of gravity according to second detection signals from a second detector and generating the second detection signals according to the detected angle, the second detector being configured to detect the angle of the center line relative to the direction of gravity;

determining whether the display apparatus is in the horizontal plane according to the detected angle; and generating and outputting a control signal to start the first detector when the display apparatus is in the X-Y plane.

* * * * *